US007748809B2

(12) United States Patent
Takahashi et al.

(10) Patent No.: US 7,748,809 B2
(45) Date of Patent: Jul. 6, 2010

(54) PRINTING APPARATUS AND PRINTING METHOD

(75) Inventors: Kiichiro Takahashi, Yokohama (JP); Minoru Teshigawara, Yokohama (JP); Tetsuya Edamura, Kawasaki (JP); Akiko Maru, Tokyo (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 276 days.

(21) Appl. No.: 11/954,940

(22) Filed: Dec. 12, 2007

(65) Prior Publication Data

US 2008/0143765 A1 Jun. 19, 2008

(30) Foreign Application Priority Data

Dec. 19, 2006 (JP) ..... 2006-341384

(51) Int. Cl.
*B41J 25/308* (2006.01)
*B41J 29/393* (2006.01)
*B65H 5/02* (2006.01)

(52) U.S. Cl. ..... 347/8; 347/19; 347/104; 271/273

(58) Field of Classification Search ..... 347/8, 347/104
See application file for complete search history.

(56) References Cited

U.S. PATENT DOCUMENTS 6,343,203 B1 * 1/2002 Pang ..... 399/307
6,761,425 B2 7/2004 Kawaguchi et al.
7,052,100 B2 * 5/2006 Otsuki ..... 347/19
7,445,302 B2 * 11/2008 Edwards et al. ..... 347/8
7,527,371 B2 * 5/2009 Yanagi et al. ..... 347/104
2005/0058480 A1 * 3/2005 Ohashi et al. ..... 400/55
2006/0044380 A1 3/2006 Yazawa et al.
2007/0070099 A1 * 3/2007 Beer et al. ..... 347/8

FOREIGN PATENT DOCUMENTS

JP 2002-254736 9/2002

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

In the ink-jet printing apparatus, the influence of displacements of printing positions caused by the excessive conveyance of a printing medium to the resultant image when the rear end of the printing medium exits from a nip portion between the roller pair in a conveying mechanism. More specifically, in the printing operation for the rear end portion of the printing medium in which the printing medium exits from the roller pair, the guide shaft for supporting the carriage is lifted at a position wherein a head-medium distance is changed to widen a distance between the printing had and the printing medium (S402). Thereby, the displacement of the landing position caused by the excessive conveyance of the printing medium is inconspicuous because of the variations of the landing positions due to the widening of the head-medium distance.

6 Claims, 14 Drawing Sheets

| | HEAD-MEDIUM DISTANCE 0 | HEAD-MEDIUM DISTANCE 1 | HEAD-MEDIUM DISTANCE 2 |
|---|---|---|---|
| HEAD-MEDIUM DISTANCE (mm) | 1.0 | 1.4 | 1.5 |
| ADJUSTMENT VALUE | 8 | 12 | 14 |

FIG.12

PRIOR ART

PRINTING APPARATUS AND PRINTING METHOD

BACKGROUND OF THE INVENTION

1. Field of the Invention

The present invention relates to an ink-jet printing apparatus and an ink-jet printing method using this apparatus, and more specifically to handling a conveyance error generated when a rear end of a printing sheet exits from a nipped portion of a conveying roller.

2. Description of the Related Art

Recently, personal computers, word processors and facsimile apparatuses have become widely used in offices and homes, whereby various kinds of printing apparatuses have been provided as information outputting equipments for these apparatuses. Of them, printers of an ink-jet type are relatively easily accommodated to color printings using a plurality of kinds of ink. Also, the printers of this type have various advantages, such as low in noise during the operation and capable of forming high grade images on various kinds and types of printing sheets or small in size. In view thereof, the printers of this type are suitable for the business use in offices or the personal use in homes. Among the printing apparatuses of the ink-jet type, those of a serial type wherein scanning of a printing head is performed to a printing sheet to print an image thereon have been widely used for a high grade image being printable at a low cost.

While the serial printing apparatus is relatively low in cost on one hand, high printing performances are desired on the other hand. Particularly, one of the desired printing performances is typically the printing of high quality image. One factor for obtaining the high quality image is a positional accuracy of landed ink dots. In general, while a factor for determining the positional accuracy of the landed ink dot may be the ejection stability of the printing head such as a non-ejection or a displacement of the ejection direction, in the recent high quality image printing, the conveying accuracy of the printing apparatus itself for conveying the printing sheet becomes important.

Conventionally, the printing apparatuses such as printers, copiers or facsimile apparatuses, use a conveying roller and pinch roller for generating a conveying force by pressing the printing sheet onto the conveying roller and nipping the same between both the rollers, as means for conveying the printing sheet. Also, a mechanism may be provided for generating a bias for urging the pinch roller as described above. This conveying mechanism conveys the printing sheet fed from a paper feeding section to a printing area by the printing head, wherein a set of the mechanism is generally provided at each of positions before and after the printing area, respectively. Thereby, it is possible to convey the printing sheet along the printing area at a high accuracy and impart the predetermined tension to the printing sheet so that a wider portion thereof is maintained in a flat state.

FIG. 13 is a cross-sectional view of the printing apparatus of the ink-jet type, mainly showing a conveying mechanism for a printing sheet.

In FIG. 13, a printing head unit 7 mounted on a carriage 5 scans in the vertical direction relative to a paper surface and ejects ink during the scanning to carry out the printing. The printing sheet P is conveyed generally in the horizontal direction from a right side to a left side in the drawing beneath the carriage 5, for the printing area by the printing head unit. More specifically, on the upstream and downstream sides of a printing sheet conveying path, a set of a conveying roller (hereinafter referred also to an LF roller) 36 and pinch roller 37 and another set of discharge roller 41 and a spur 42 are provided, respectively, as the above-mentioned two sets of the conveying mechanism. Among them, the pinch roller 37 is pivoted on a rotary shaft provided in a pinch roller holder 30 and is pressed onto the conveying roller 36 by that the pinch roller holder 30 is biased by a pinch roller spring 31. Similarly, a pressure is also applied between the discharge roller 41 and the spur 42 by a pressing mechanism not shown. Thus, the printing sheet P is nipped by the two sets of rollers, and the conveying roller 36 is made rotate by a motor not shown. With this, the discharge roller 41 connected to the conveying roller 36 via a predetermined gear trains is made rotate, whereby the printing sheet P is intermittently conveyed at a predetermined distance at every scanning motion of the printing head.

In this regard, according to the above-mentioned conveying mechanism, when a rear end portion of the printing sheet exits from a nipped portion between the conveying roller and the pinch roller, the printing sheet may be discharged in the conveying direction by the biasing force of the pinch roller. In such a case, the conveying roller and the discharge roller further rotate by a backlash of the gear trains driving such rollers, whereby the printing sheet P may be conveyed more than a predetermined intended value. As a result, a position of the printing head relative to the printing sheet P is shifted from a regular position, whereby a position of a dot formed on the printing sheet P by the ink ejected from the printing head (an image position) deviates to degrade the quality of the printed image.

FIGS. 14A and 14B illustrate the positional relationship between the conveying roller 36 and the pinch roller 37. As shown in FIG. 14B, the conveying roller 36 has a length corresponding to a width of the printing sheet P to be conveyed, while a plurality of the pinch rollers 37, each having a shorter length, are disposed corresponding to the conveying roller 36. In this structure, when the rear end of the printing sheet P exits from the nipped portion between the conveying roller 36 and the pinch roller 37, the pinch roller 37 shift toward the conveying roller side at a distance corresponding to a thickness of the printing sheet P nipped thereby until this instant. According to this shift, the above-mentioned biasing force of the pinch roller generates, and the excessive length of the printing sheet P more than the predetermined value is conveyed as described above.

Particularly, if the printing sheet has relatively large thickness as glossy paper, the above-mentioned biasing force of the pinch roller becomes large to increase the excessive amount of the printing sheet to be conveyed.

As a countermeasure to the above-mentioned conveyance error, a system may be considered in which a brake is provided against the rotation of the conveying roller to restrict the excessive conveyance of the printing sheet upon the exiting thereof from the nipped portion. In such a case, however, there is a problem in that a loading torque for driving the conveying roller becomes large, whereby a grade of a motor for driving it must be grade-up or the conveying speed becomes insufficient.

On the other hand, Japanese Patent Laid-Open No. 2002-254736 discloses a printing method that reduces the displacement of the image position caused by the excessive conveyance of the sheet upon exiting from the nip of the roller sets as described above, wherein the displacement of the printed position due to the above-mentioned excessive conveyance is absorbed while allowing the increase in a conveyance amount upon exiting from the nip but shifting the nozzles used for printing corresponding to increased conveyance amount.

In the method disclosed in Japanese Patent Laid-Open No. 2002-254736, however, it is necessary to provide correction nozzles for the purpose of shifting, which is not used for the printing in a normal area, whereby the driving control of the printing head is relatively complicated.

Also, it may be considered that the excessive conveyance of the printing sheet is prevented by separating the conveying roller from the pinch roller before the rear end of the printing sheet exiting from the nipped portion between both the rollers to release the printing sheet from the nipping of the rollers. In this case, however, since the printing sheet is nipped solely by one set of discharge roller and the like, the conveyance accuracy thereof is degraded to deteriorate the quality of the printed result.

In this regard, there are many cases wherein a slight variation of the ejecting direction exists in the respective printing head of the ink-jet method. That is, due to the deviation of the ejecting direction from the regular direction, the landing positions of the ink droplets on the printing sheet may also similarly vary. Such variation of the landing positions, however, is negligible on the printing quality since the above-mentioned deviation of the ejecting direction itself is relatively small and a distance between the printing head and the printing sheet (hereinafter also referred to as "a head-medium distance") is determined to be relatively small. Also, when the variation of the landing positions is significant, a so-called multi-pass printing may be adopted as a countermeasure thereto. When the head-medium distance is widened, however, the above-mentioned deviation of the ejecting direction enlarges the displacement of the landing positions.

SUMMARY OF THE INVENTION

The present invention has been made based on such a view point. That is, an object of the present invention is to reduce an influence of the displacement of the printed positions upon an image that is caused when a printing sheet disengages from a nip by a pair of rollers of a conveying mechanism in an ink jet printing apparatus.

In a first aspect of the present invention, there is provided an ink jet printing apparatus that uses a printing head ejecting ink to eject ink to a printing sheet for performing printing; the apparatus comprising: a pair of rollers for rotating with nipping the printing sheet to convey the printing sheet to a position on which the printing is performed by the printing head; a first printing control unit that causes a distance between the printing head and the printing sheet to be a first distance and executes printing by using the printing head; a second printing control unit that causes the distance between the printing head and the printing sheet to be a second distance greater than the first distance and executes printing by using the printing head; and a changing unit that causes the first printing control unit to begin to execute printing, and changes printing by the first printing control unit into printing by the second printing control unit before the printing sheet exits from a nip between the pair of rollers, in a printing operation for the printing sheet.

In a second aspect of the present invention, there is provided an ink jet printing method of using a printing head ejecting ink to eject ink to a printing sheet, which is conveyed by rotation of a pair of rollers with nipping the printing sheet, for performing printing; the method comprising: a step of causing a distance between the printing head and the printing sheet to be a first distance and beginning printing by using the printing head; and a step of causing the distance between the printing head and the printing sheet to be a second distance greater than the first distance before the printing sheet exits from a nip between the pair of rollers, and executing printing by using the printing head.

According to the above configuration, a displacement of landing positions of the ejected ink caused when a printing sheet exits from the nip by a pair of rollers can be made inconspicuous by increasing the head-medium distance to intentionally vary the landing positions.

Further features of the present invention will become apparent from the following description of exemplary embodiments with reference to the attached drawings.

BRIEF DESCRIPTION OF THE DRAWINGS

FIG. 12 is a table of the adjusted registration values obtained by the above-mentioned steps for obtaining the adjusted registration values;

DESCRIPTION OF THE EMBODIMENTS

An embodiment of the present invention will be described below in detail with reference to the attached drawings. An ink-jet printer is cited as the embodiment of an ink-jet printing apparatus according to the present invention.

Structure of Ink-Jet Printer

Figure 1:
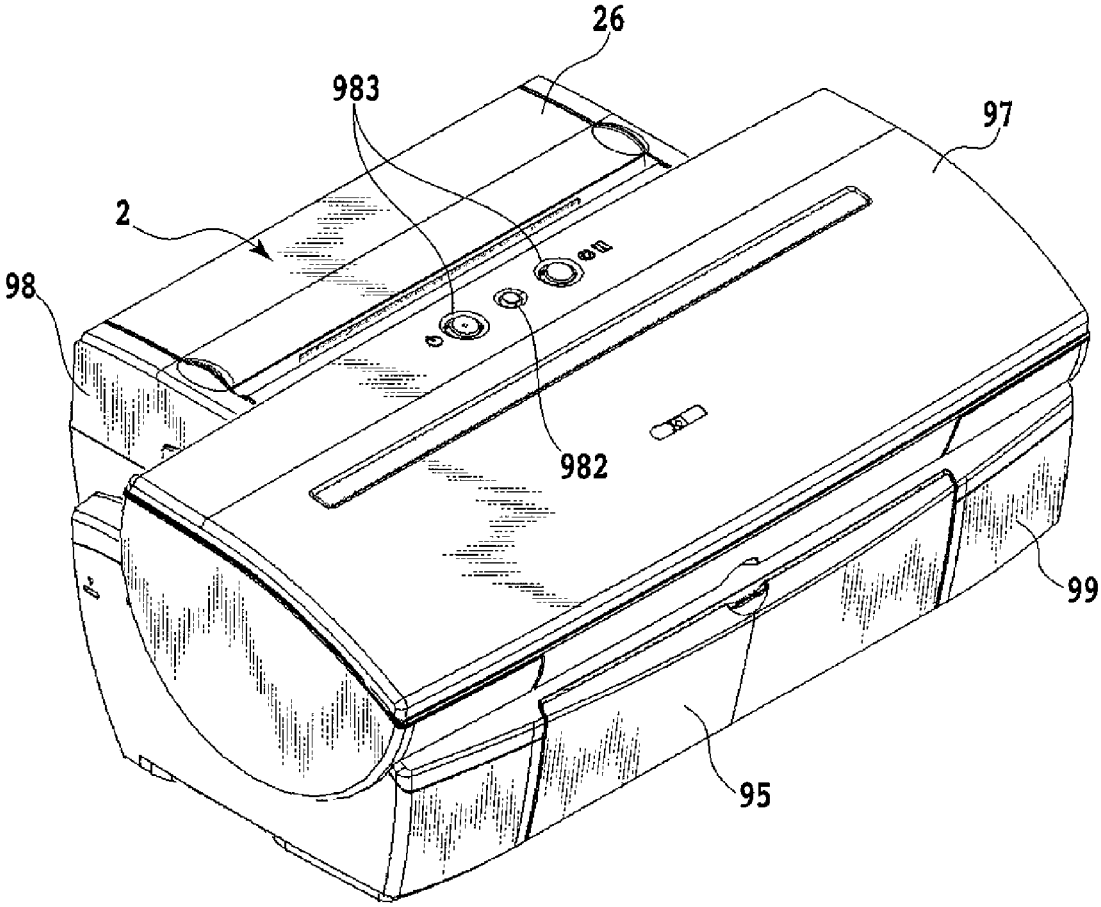
FIG. 1 is a perspective view illustrating one embodiment of a printing apparatus to which is applied the present invention.
Figure 13:
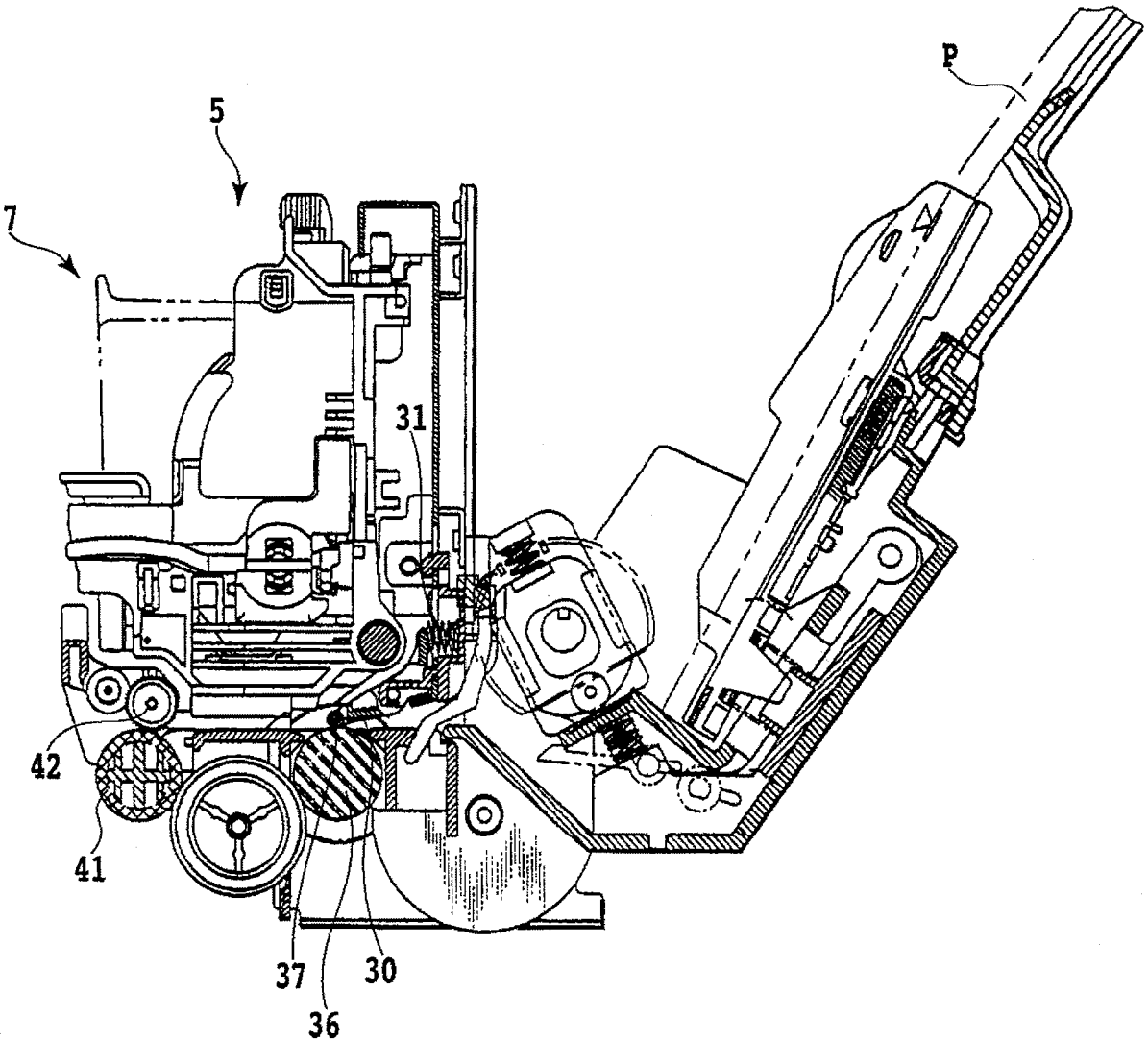
FIG. 13 is a side cross-sectional view of an ink-jet printer, particularly illustrating the printing sheet conveying mechanism thereof.
Figure 14A:
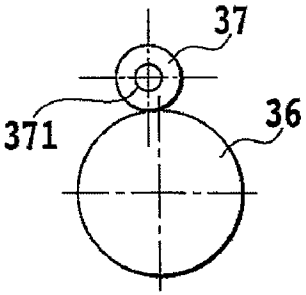
FIG.14A PRIOR ART
FIG. 14A and 14B are view illustrating the relationship between a conveying roller and pinch roller in the above-mentioned conveying mechanism.
Figure 14B:
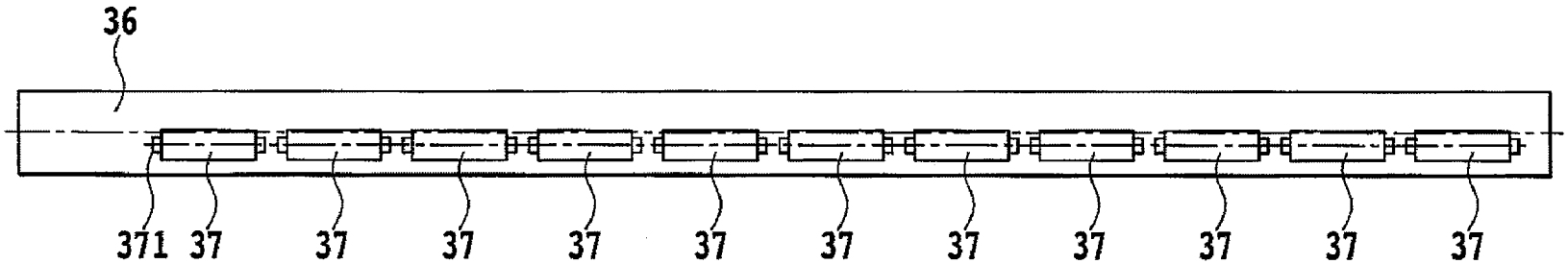
FIG.14B PRIOR ART

FIG. 1 is a perspective view illustrating an appearance of the ink-jet printer according to the embodiment of the invention. The printer which appearance is shown in FIG. 1 has the same mechanism therein as that shown in FIG. 13. An outer housing of this printer shown in FIG. 1 includes a lower case 99, an upper case 98, an access cover 97, a connector cover 96 and a front cover 95. In the upper case, a sheet-feeding tray 26 is rotatably provided. From this sheet-feeding section, the sheet is fed to the printing sheet conveying passage shown in FIG. 13. The printed sheet is discharged through a delivery tray (not shown since it is in a stored state) provided in a bottom space of the lower case 99. In the upper case 98, the access cover 97 is rotatably provided. An opening is formed on part of the top surface of the upper case 98, through which an ink tank and a printing head may be exchangeable. Also, in a portion of the upper case 98, an LED guide 982, a key switch 983 or others may be provided.

Control Block

Figure 2:
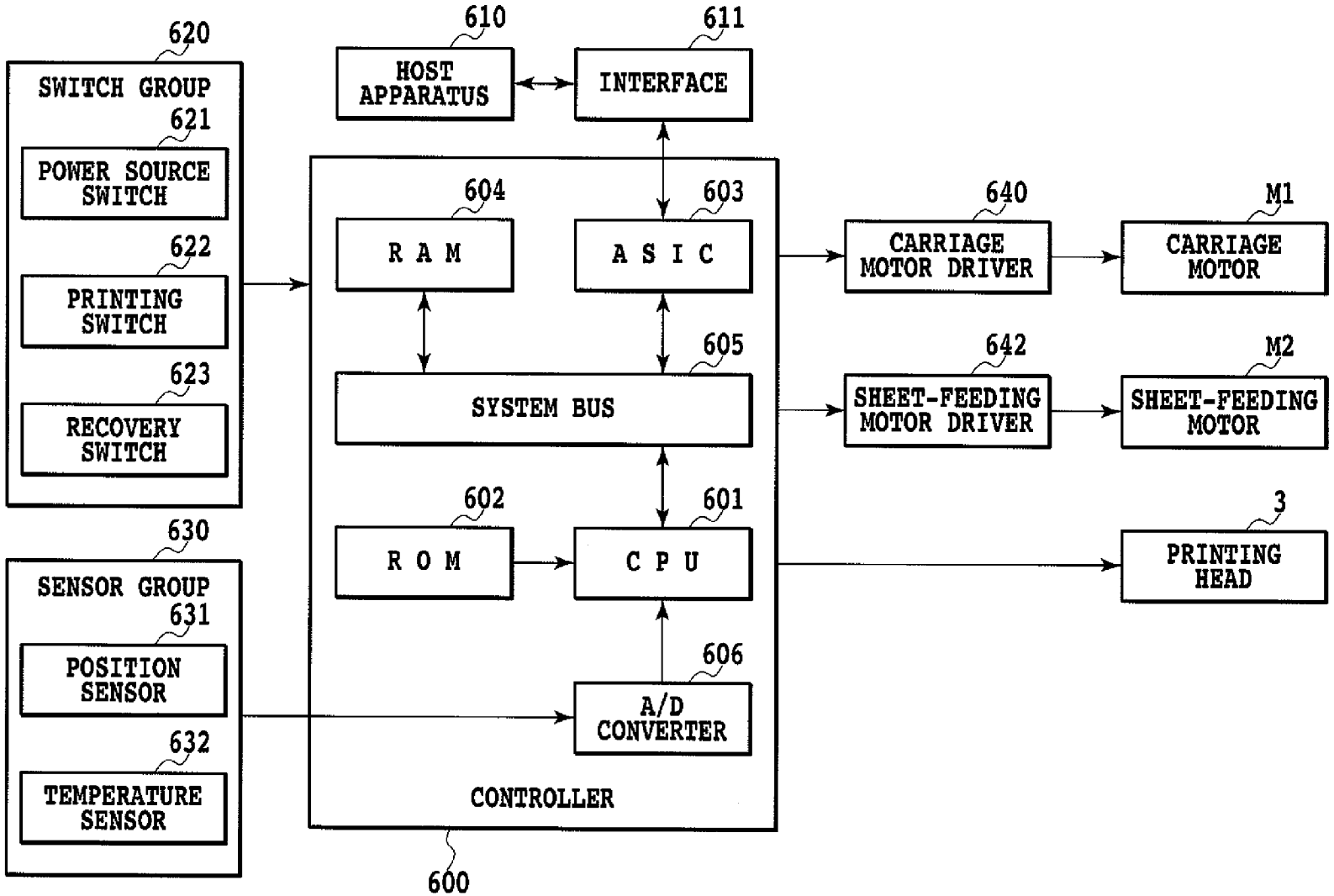
FIG. 2 is a block diagram illustrating a diagrammatic construction of a system for controlling the ink-jet printing apparatus shown in FIG. 1.

FIG. 2 is a block diagram illustrating a diagrammatic structure of a control system for the printer shown in FIG. 1.

As shown in FIG. 2, a controller 600 includes CPU 601 in a form of a microcomputer, ROM 602, ASIC 603, an A/D converter 606 or other. ROM 602 stores programs for executing various printing modes described later with reference to FIG. 3 and the like, controlling the printing operation therein or corresponding to the sequence of the image processing described later, tables or fixed data necessary therefor. ASIC (Application Specific Integrated Circuit) 603 generates signals for controlling a carriage motor M1 and a sheet-feeding motor M2 or controlling the ejection of ink in the printing head 3. In ROM 604, an area for developing image data and/or an operation area may be provided. A system bus 605 connects CPU 601, ASIC 603 and ROM 604 to each other to transmit/receive data. The A/D converter 606 receives analog signals from a sensor group described below and converts the same to digital signals which are then fed to CPU 601.

Reference numeral 610 denotes a host computer (or an image reader or a digital camera) as a supply source of image data. The host device 610 transmits/receives image data, commands, status signals or others to/from the controller 600 via an interface (I/F) 611.

Reference numeral 620 denotes a switch group including switches for receiving command input from the operator, such as a power source switch 621, a switch 622 for indicating the initiation of the printing process, or a recovery switch 623 for indicating the initiation of the recovery process for the printing head 3. Reference numeral 630 denotes a sensor group including a photo-coupler 631 combined with the above-mentioned scale 8, for detecting that the printing head 3 is positioned at a home position h by the movement thereof, a temperature sensor 632 provided at a suitable location of the printer for detecting the environmental temperature, or others. Further, reference numeral 640 denotes a driver for driving the carriage motor M1 and 642 denotes a driver for driving the sheet-feeding motor M2.

In the above configuration, the printer of this embodiment analyzes a command transferred via the interface 611 and develops image data to be printed in RAM 602. The buffer for developing the image data has a horizontal size corresponding to the number of pixels Hp in the printing area in the main scanning direction, and a vertical size corresponding to a nozzle row in the printing head which corresponds to the number of pixels 64*n* (n is an integer of 1 or more) printed by a single scan. A memory area on RAM 602 referred to when transmitting data to the printing head during the printing scan has a horizontal size corresponding to the number of pixels Vp in the main scanning direction and a vertical size corresponding to the number of pixels 64*n* in the vertical direction to be printed in a single scan of the printing head.

ASIC 603 obtains driving data for heaters of the respective nozzle in the printing head while having direct access to the memory area of RAM 602 and transfers them to the driver for the printing head.

Printing Operation

Figure 3:
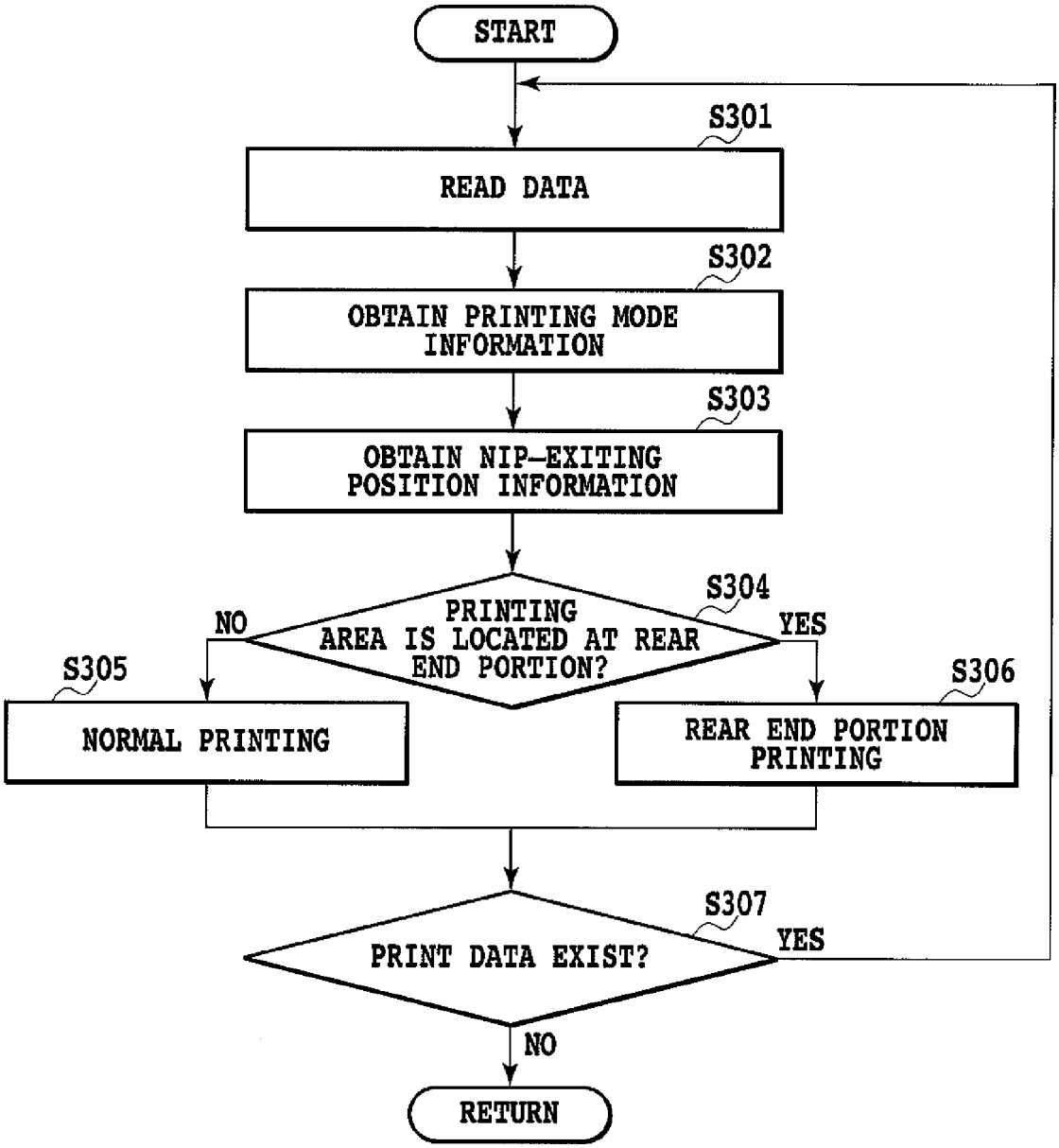
FIG. 3 is a flow chart illustrating the printing steps according to one embodiment of the present invention.

FIG. 3 is a flow chart showing the control procedure of a printing operation including the printing to a rear end portion of a printing sheet according to one embodiment of the present invention.

In FIG. 3, at the start, the printing data is read at step 301. The read data are of a form coinciding with a data flow of this printer. Generally in many cases, the data are image data taken from an application used in PC or others, and converted to the printing data understandable by the printer driver. Alternatively, the image data may be directly read from the image input device or the like and printing is carried out while converting the same to the print data in the printing apparatus side. The present invention is applicable to either of the data forms. Then, at step 302, the print data are analyzed for obtaining printing mode information. Here, various information necessary for the printing are obtained, such as a printing sheet to be printed, a sheet size or a printing mode.

At step 303, information of an exiting-from-nip position is obtained based on the information obtained at the preceding step 302.

Figure 5:
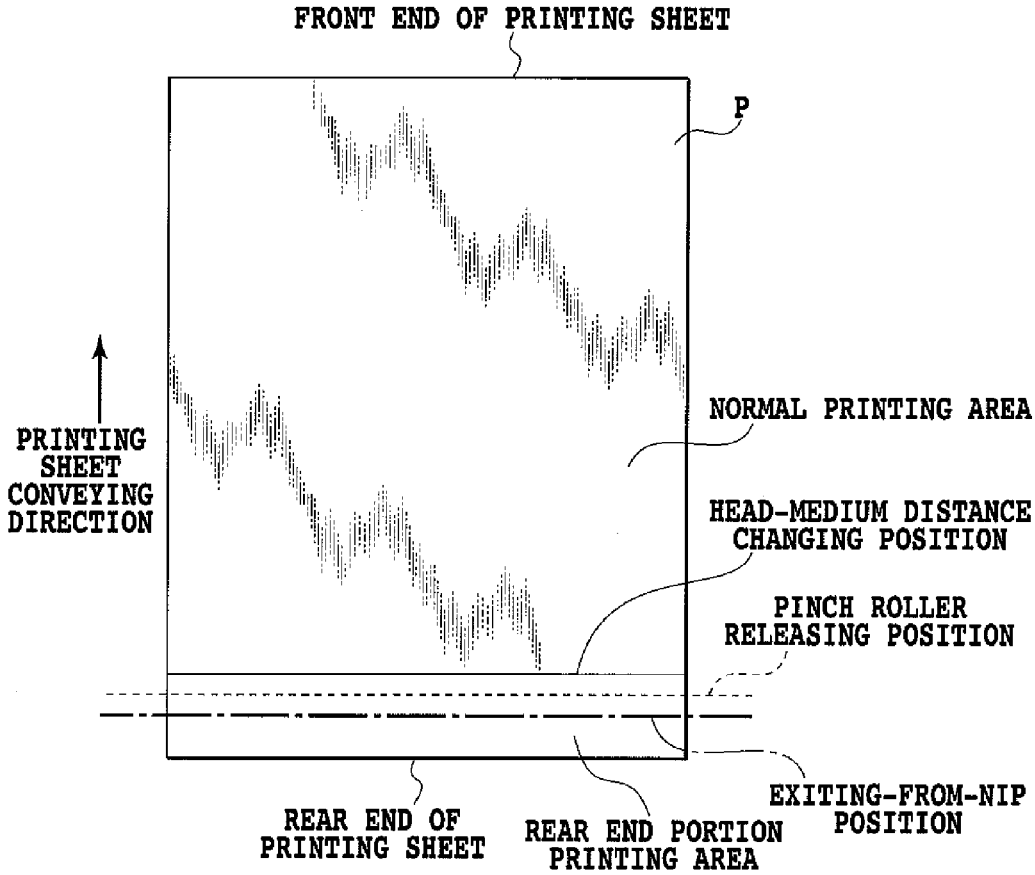
FIG. 5 is a view illustrating the printing control according to one embodiment of the present invention carried out on the printing area of the printing sheet.

FIG. 5 is a view illustrating positional information, such as the exiting-from-nip position, used for a printing control described later. Note that FIG. 5 shows respective positions on which position a printing area (scanning area) by the printing head is located on a printing sheet P. "The exiting-from-nip position" means a position on the printing sheet shown in FIG. 5 at which the printing area is located when a rear end of the printing sheet P exits from between the conveying roller 36 and the pinch roller 37. In this regard, while the area printed by the printing head has a predetermined width (a scanning width) in the conveying direction in FIG. 5, the above-mentioned position is defined, for example, by using the upstream end of this area in the conveying direction as a reference.

Here, it is possible to uniformly define the exiting-from-nip position and the like in such a manner that how long a distance (mm) of the reference of the printing area from the front or rear end of the printing sheet generally. This position may, however, be variable due to the tolerance of parts in the apparatus or the dimensional tolerance of the printing sheet. In this embodiment, the exiting-from-nip position or others is defined as a position at which the printing sheet is conveyed at predetermined distances after the front or rear end of the printing sheet has been detected by a PE (paper end) sensor via a PE sensor lever. For example, the PE sensor is provided in the conveying passage at a position close to the nipped portion between the conveying roller 36 and the pinch roller 37 on the upstream side. Then, a position of the printing sheet conveyed at a predetermined distance after the rear end of the printing sheet has been detected by the sensor lever is defined as the "exiting-from-nip position". In FIG. 5, the respective positions defined in such a manner are illustrated on the printing sheet as those at which the printing area exists. Note that if the tolerance of parts in the apparatus is extremely small, the exiting-from-nip position may be uniformly defined based on a length of the printing sheet in the conveying direction by counting the length from the initiation of the conveyance of the printing sheet.

As described hereinabove, the "exiting-from-nip position" is a position at which the printing sheet is exited from a nip portion between the conveying roller and the pinch roller and an excessive conveyance may occur. According to this embodiment, information of this position is preliminarily obtained and various positions are determined based thereon as described below.

That is, at step 304, it is determined whether or not the printing area coincides with the rear end portion. The rear end portion is a position at which the printing area comes prior to coming at the exiting-from-nip position. According to this embodiment, when the printing area comes at a "head-medium distance changing position" in FIG. 5, it is determined that this portion of the printing sheet is the rear end portion. More specifically, a position before the printing sheet has been conveyed at a predetermined amount relative to the exiting-from-nip position obtained at step 303 is defined as the "head-medium distance changing position", and it is determined whether or not the printing area coincides with the rear end portion depending upon whether the printing area comes at the "head-medium distance changing position".

If it is determined that the printing area does not coincide with the rear end portion, the routine goes to step 305 at which the normal printing is carried out. Contrarily, if it is determined that the printing area coincides with the rear end portion at step 304, the routine goes to step 306 at which the printing of the rear end portion is carried out.

Next, at step 307, it is determined whether or not the printing data exists. If the answer is negative, the sequence is finished. Contrarily, if the answer is affirmative, the routine returns to step 301 at which this operation is repeated.

(Printing of Rear End Portion)

Figure 4:
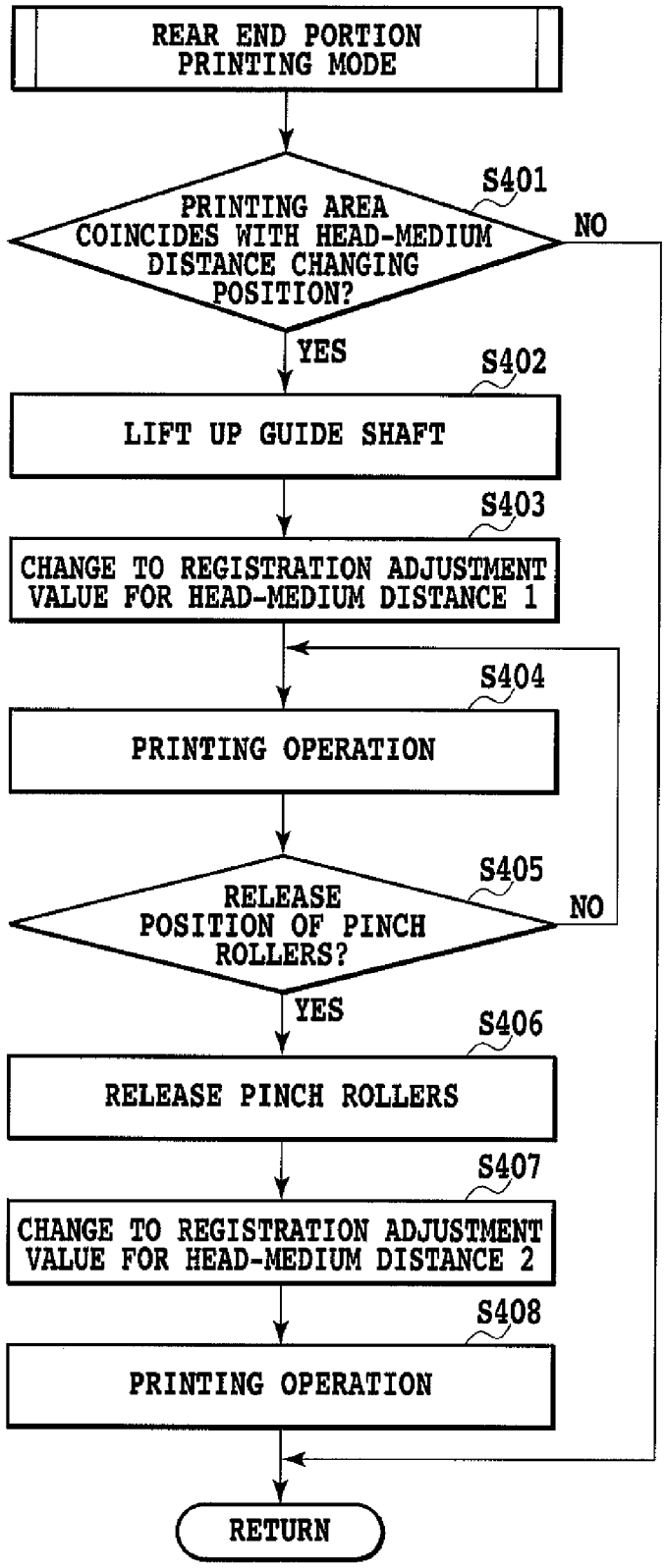
FIG. 4 is a flow chart illustrating the printing steps in a rear end portion of a printing sheet shown in FIG. 3.

FIG. 4 is a flow chart showing the printing of the rear end portion shown in FIG. 3 in detail.

Initially, at step 401, it is determined whether or not the printing area comes at the head-medium distance changing position. According to this embodiment, as described in FIG. 3, the determination whether or not the printing area coincides with the rear end portion is made based on the determination whether or not the printing area comes at the "head-medium distance changing position". When the coincidence of the printing area with the head-medium distance changing position has the same meaning as the printing area enters the rear end portion as mentioned above, this step is eliminated. The rear end portion is a region primarily provided in a so-called margin-less printing carried out by this embodiment. In the margin-less printing, the printing is made even in the low conveyance accuracy after the printing sheet has exited from the nip between the conveying roller and the pinch roller so that the printing operation is carried out all over the printing sheet with no blank even at a final end of the printing sheet. For this purpose, an area wherein the printing is carried out in a state free from the roller nip is provided as the rear end portion. In this area, the printing operation is carried out in a different mode from that in the normal area, for example, by reducing the conveying amount of the printing sheet so that the lowering of the conveyance accuracy is compensated.

According to this embodiment, a boundary between the rear end portion and the normal printing area is equal to the "head-medium distance changing position". At the head-medium distance changing position, the head-medium distance is made lager than that in the normal printing area.

If the head-medium distance is increased in such a manner, the variation of the landing positions becomes larger, whereby the displacement of the landing positions caused by the excessive conveyance of the printing sheet is inconspicuous when the printing sheet exits from the nip portion between the conveying roller and the pinch roller. Accordingly, as one embodiment of the present invention, a structure maybe possible wherein the printing sheet exits from the roller nip as being conveyed without separating the pinch roller from the conveying roller before the printing sheet exits from the roller nip as described later at step 406. Thereby, the variation of the landing positions is intentionally increased by widening the head-medium distance as described above. Accordingly, it is possible that the displacements of the landing positions are inconspicuous, which are caused by the excessive conveyance of the printing sheet when the printing sheet exits from the nip portion between the conveying roller and the pinch roller.

Since the above-mentioned excessive conveyance amounts of the printing sheet are different from each other in accordance with kinds of printing sheet, when exiting from the nip portion between the conveying roller and the pinch roller, the head-medium distance may be changed in accordance with the kinds of printing sheet to be used.

For instance, for a glossy paper having a relatively large thickness, since the excessive conveyance amount of the printing sheet becomes larger when the rear end thereof exits from the nip portion between the conveying roller and the pinch roller, it is thought that the amount of the head-medium distance may be largely changed.

On the contrary, for the relatively thin printing sheet, the change of the head-medium distance is smaller or, in an extreme case, the head-medium distance may not be changed at all.

On the other hand, in this embodiment, as described at step 406, the pinch roller are separated from the conveying roller prior to the printing sheet exiting from the nip portion to be made disengage from the nipping between the conveying roller and the pinch roller. Accordingly, there is no excessive conveyance of the printing sheet caused by the exit thereof from the nip portion. Even in such a case, however, the conveyance accuracy is lowered in the rear end portion printed by the margin-less printing according to this embodiment since the printing sheet is held solely by the downstream side discharge roller and the like. Thereby, the landing positions are displaced due to this low conveyance accuracy. According to the rear end portion printing mode in this embodiment, for the purpose of compensating the displacement of the landing position, the head-medium distance is widened to intentionally increase the variation of the landing positions so that the displacements of the landing positions are inconspicuous. Accordingly, in the rear end portion printing mode in this embodiment, the control of the rear end portion printing known in the prior art is not adopted, such as by decreasing the conveyance amount of the printing sheet. In this regard, the change of the head-medium distance (the initiation of the rear end portion printing operation) is carried out at a position prior to a position at which the pinch roller are released or the printing sheet exits from the nipped portion, as shown in FIG. 5. The purpose thereof is to obtain a control margin taking the conveyance accuracy of the printing sheet into account, whereby the rear end portion printing is necessarily carried out at a position wherein the pinch roller are released or the printing sheet exits from the nipped portion.

While it is determined whether or not the printing area is at the head-medium distance changing position at step 401, if this position does not coincide with a position at which a mode is changed to the rear end portion printing mode, it is separately determined whether or not this position is a position at which a mode is changed to the rear end portion printing mode.

While it is efficient that the position at which the rear end printing mode is the same to the head-medium distance changing position, to improve the control accuracy, a plurality of determination steps may be carried out as described above. When a surer control is necessary as in the above manner, the determination must be carried out at a plurality of steps. However, if it is desired to restrict the control time, the determination may be once.

As described above, if it is determined at step 401 that the printing area coincides with the head-medium distance changing position, at step 402, a guide shaft supporting the carriage is moved upward in the vertical direction relative to the printing sheet to increase a distance between the printing head and the printing sheet; i.e., the head-medium distance. In this regard, a mechanism for moving the guide shaft upward may be a known technique. For example, the guide shaft may be moved upward and downward by rotating eccentric cams attached to opposite ends of the guide shaft by a driving force of a motor.

In moving the guide shaft upward for changing the head-medium distance, moving upward the guide shaft may be performed plurality of times to reach the set head-medium distance so that the head-medium distance is increased in a stepwise fashion. For example, the guide shaft may be moved upward every scanning of the printing head so that the plurality of times of scanning of the printing head allow the guide shaft to be moved plurality of times so as to reach the set head-medium distance in the step wise fashion.

Next, at step 403, the registration adjustment (the adjustment of the printing position) is carried out at a head-medium distance 1 which is obtained by changing the head-medium distance. In this registration adjustment, the printing position of the printing head in the scanning direction; that is, the landing position is adjusted. The reason for increasing the variation of the landing positions by increasing the head-medium distance as described above is to make the displacements of the landing positions inconspicuous in the conveying direction of the printing sheet. Accordingly, to compensate for the variation of the landing positions in the scanning direction caused by the increasing of the head-medium distance, the registration adjustment described later with reference to FIG. 6 and thereafter.

Next, at step 404, the printing operation is carried out. At step 405, it is determined whether or not the printing area coincides with a release position of the pinch roller. The release position at which the pinch roller are separated from the conveying roller in press-contact therewith is provided as shown in FIG. 5 at a location before the printing area reaching the exiting-from-nip position. In such a manner, in the rear end portion printing mode, the rear end of the printing sheet P sequentially passes the head-medium distance changing position, the pinch roller releasing position and the exiting-from-nip position (see FIG. 5). If it is determined that the printing area does not coincide with a release position at step 405, the routine returns to step 404 at which the rear end portion printing operation continues. Contrarily, if it is determined that the printing area coincides with a release position, the routine goes to step 406. In this regard, a known technique may be used as a mechanism for releasing the pinch roller. For instance, a pinch roller holder for supporting the pinch roller may be rotated about the rotary shaft thereof to separate the pinch roller from the conveying roller or bring into contact therewith.

At step 406, the pinch roller is released from pressing to the conveying roller. Then at step 407, a registration adjustment value is changed to a registration adjustment value of a head-medium distance 2 corresponding to a head-medium distance after the releasing. More specifically, although the actual change of the head-medium distance as at step 402 is not carried out when the pinch roller are released, the pressure applied on the printing sheet is none due to the separation of the pinch roller.

In view of no application of the pressure, an increased head-medium distance is set and the registration adjustment is performed correspondingly to the increased head-medium distance. Similar to the registration adjustment for the head-medium distance 1, this registration adjustment is performed so that the landing positions are adjusted in the scanning direction of the printing head. After this registration adjustment, the printing operation is carried out at step 408 and the routine is finished.

While the head-medium distance 2 varies in accordance with states of the printing sheet held between the conveying roller and the pinch roller, the head-medium distances 1 and 2 are preferably equal to each other. However, both the values may be somewhat different from each other due to the tolerance or others of parts forming the apparatus. Accordingly, the respective apparatus may have inherent registration adjustment values or correction values. Also, when the behavior of the printing sheet to the deflection causes the variation of the head-medium distance, the correction values may be prepared in accordance with characteristics of the printing sheets. On the control sequence, the head-medium distances 1 and 2 are independent parameters, respectively, capable of setting the registration adjustment values or being corrected in accordance with the registration adjustment values.

(Registration Adjustment in the Scanning Direction)

The registration adjustment in the scanning direction of the printing head described above will be described in more detail below, particularly on the displacement components of the landing position, the registration adjustment control and the acquirement of the registration adjustment value.

Displacement Components of Landing Position

Figures 6A, 6B, 6C:
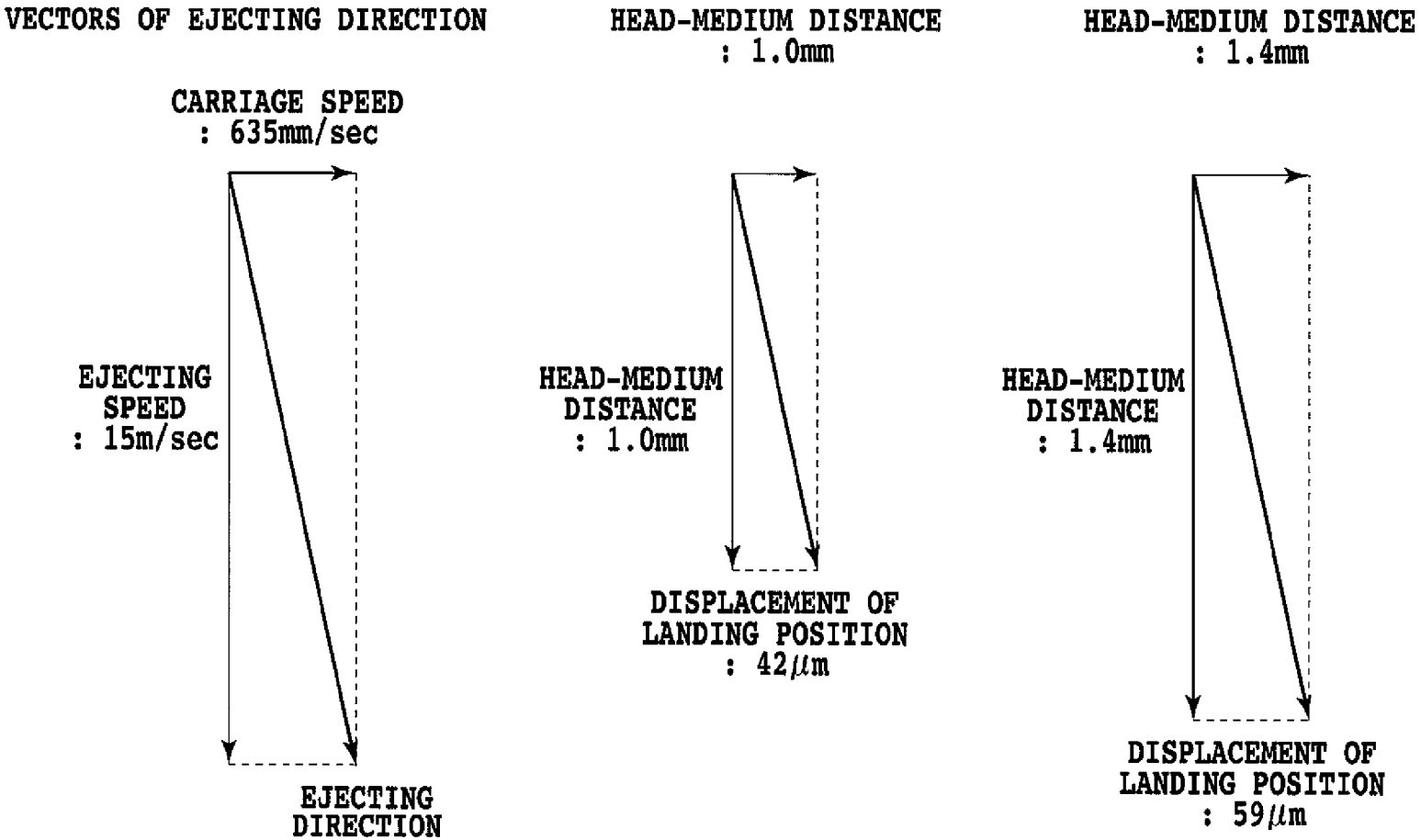
FIG. 6A, 6B and 6C are views illustrating the landing positions of ink dots, respectively, when the head-medium distance is changed according to one embodiment of the present invention.

The landing positions when the head-medium distance is changes will be described below with reference to FIGS. 6A to 6C. In FIG. 6A, the ejecting direction and the ejecting speed are illustrated as a result of the vector composition of the carriage speed of 635 mm/sec and the ink ejection speed of 15 m/sec. Even if the ink is ejected downward at certain ejection timing, the ink droplet does not land to a position directly beneath the position occupied by the printing head at the ejection instant since the carriage moves in the horizontal direction at a certain speed component, but is ejected at a certain angular component.

FIG. 6B illustrates the displacement of the landing position when the head-medium distance is 1.0 mm under the conditions of the above-mentioned carriage speed and the ejection speed. As shown in this drawing, the ink droplet lands on the printing sheet at a position displaced by approximately 42 μm from a point vertically beneath the printing head at a time of ejection. On the other hand, FIG. 6C illustrates the displacement of the landing position when the head-medium distance is 1.4 mm. In this case, the ink droplet lands at a position displaced by approximately 59 μm from a point vertically beneath the printing head at a time of ejection. In such a manner, the larger the head-medium distance, the larger the displaced amount of landing position. Accordingly, it is necessary to correct or change the registration adjustment value in correspondence thereto. The change of the registration adjustment value carried out at steps 403 and 407 is to correct this displacement. If the ejection is stable and the printing operation of the apparatus is steady, the correction of the registration adjustment value due to the change of the head-medium distance can be carried out by a simple vector calculation shown in FIGS. 6A to 6C.

Control of Registration Adjustment

Figure 7:
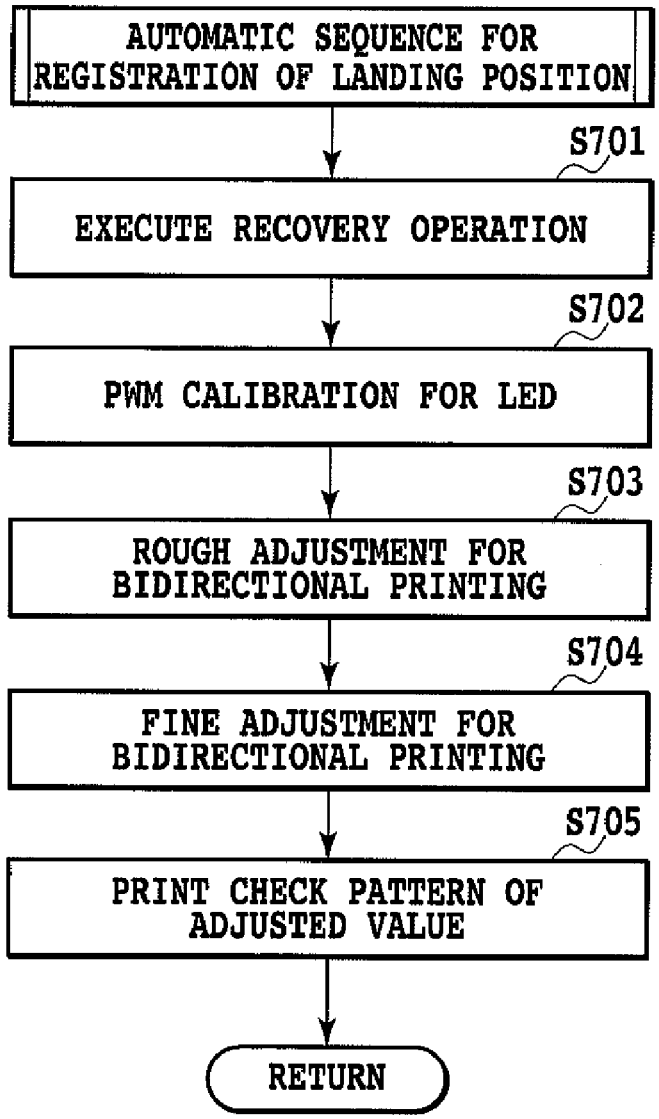
FIG. 7 is a flow chart illustrating the steps for the automatic registration of the landing position according to one embodiment of the present invention.

FIG. 7 is a flow chart showing the processes for the registration adjustment for the bidirectional printing. As shown in FIG. 7, the recovery operation of the printing head is first carried out (S701). Then, the calibration of LED for detecting the formed ink dot is carried out (S702). Next, the rough adjustment in the bidirectional printing is carried out (S703), and further the fine adjustment in the bidirectional printing is carried out (S704). Finally, the check pattern of the adjusted value is printed (S705) and the routine is finished.

In the above-mentioned calibration of LED, input power is PWM-controlled so that the output characteristic of LED is usable in the linear area. Concretely, the input power is PWM-controlled so that a current amount is controlled, for example, at a 5% interval from 100% duty to 5% duty. Thereby, it is possible to drive LED of a photo sensor at a optimum current duty.

Next, the rough adjustment in the bidirectional printing is carried out as follows. In this embodiment, the tolerance of the landing positions of printed dots in the bidirectional printing by the printer body and the printing head is ±4 dots or less. Accordingly, in the rough adjustment, a pattern having a width corresponding to 4 dots is used.

Figure 8:
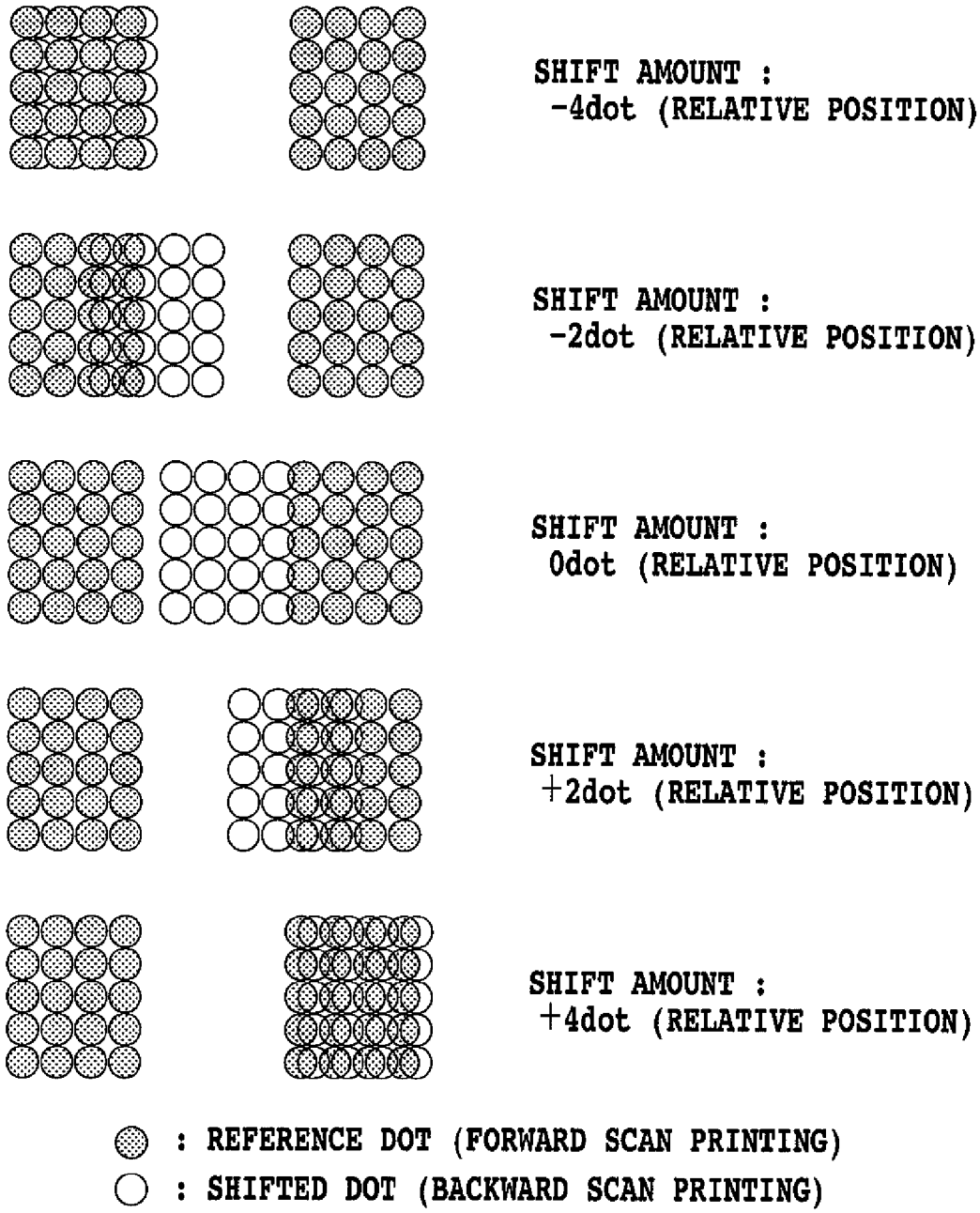
FIG. 8 is schematic illustrations of roughly adjusted printing patterns in the above-mentioned automatic operation for the registration of the landing position.

FIG. 8 illustrates one example of the rough adjustment pattern. In a forward scanning, reference dots are printed, and in a backward scanning, shifted dots are printed in which positions of dots are changed according to positional conditions. In the printing carried out without adjustment, the shifted amount is 0 dot. The displacement when printed in this condition is caused due to the accuracy of the landing position of the printer and the printing head at that time. Such a displacement is caused not only due to those inherent to the apparatus but also mainly due to the increasing of the head-medium distance as described before. This embodiment automatically adjusts this displacement. In FIG. 8, while the printing of the respective pattern is carried out within a range of shifting amount in a range of ±4 dots, this range is sufficient for achieving the object.

Figure 9:
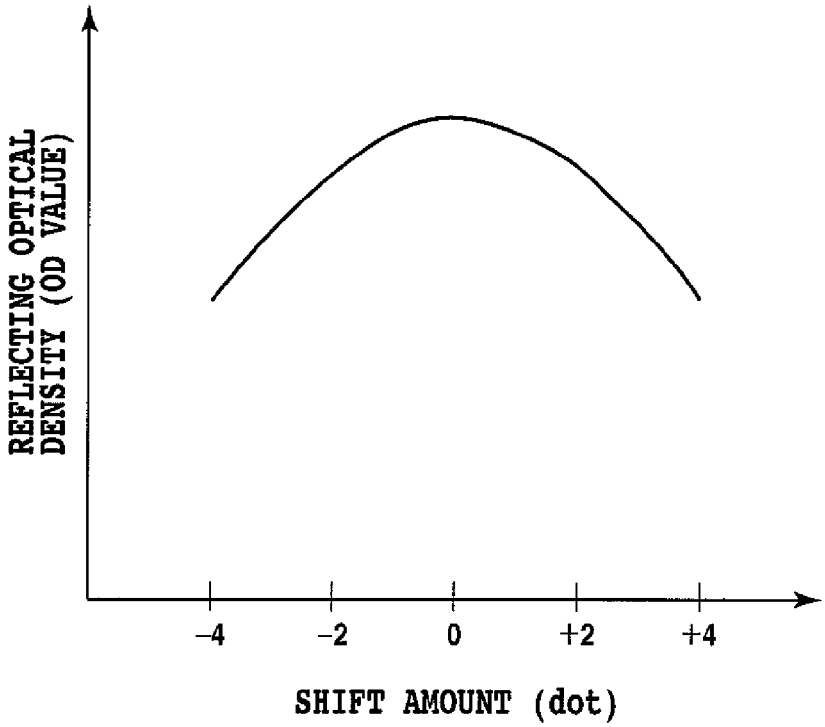
FIG. 9 is a graph illustrating the relationship between the positional displacement of the adjusted pattern and the reflectance optical density used in the above-mentioned automatic operation for the registration of the landing position.

Characteristic of the output from the photo sensor (a value of the reflected beam after subjected to the A/D conversion) in relation to the shifted amount in this case is illustrated in FIG. 9. The output characteristic in relation to the displacement amount is represented by a curve approximated by a polynomial expression. From this approximated characteristic, it is possible to employ a point at which the optical density of the reflected beam is maximized, as a displacement-adjustment value used when the bidirectional printing is carried out. In this case, an interval of the adjacent adjustment values may be set finer than that of the shifted amounts. Also, the approximation may be eliminated at this stage and the maximum value of the optical density of the reflected beam may be adopted as the adjustment value for the bidirectional printing. In this embodiment, while the interval of the pattern-displacement amounts is 2 dots, this is not limitative but may be any value provided the approximated characteristic is obtainable within a range of the tolerance accuracy of the landing positions.

Figure 10:
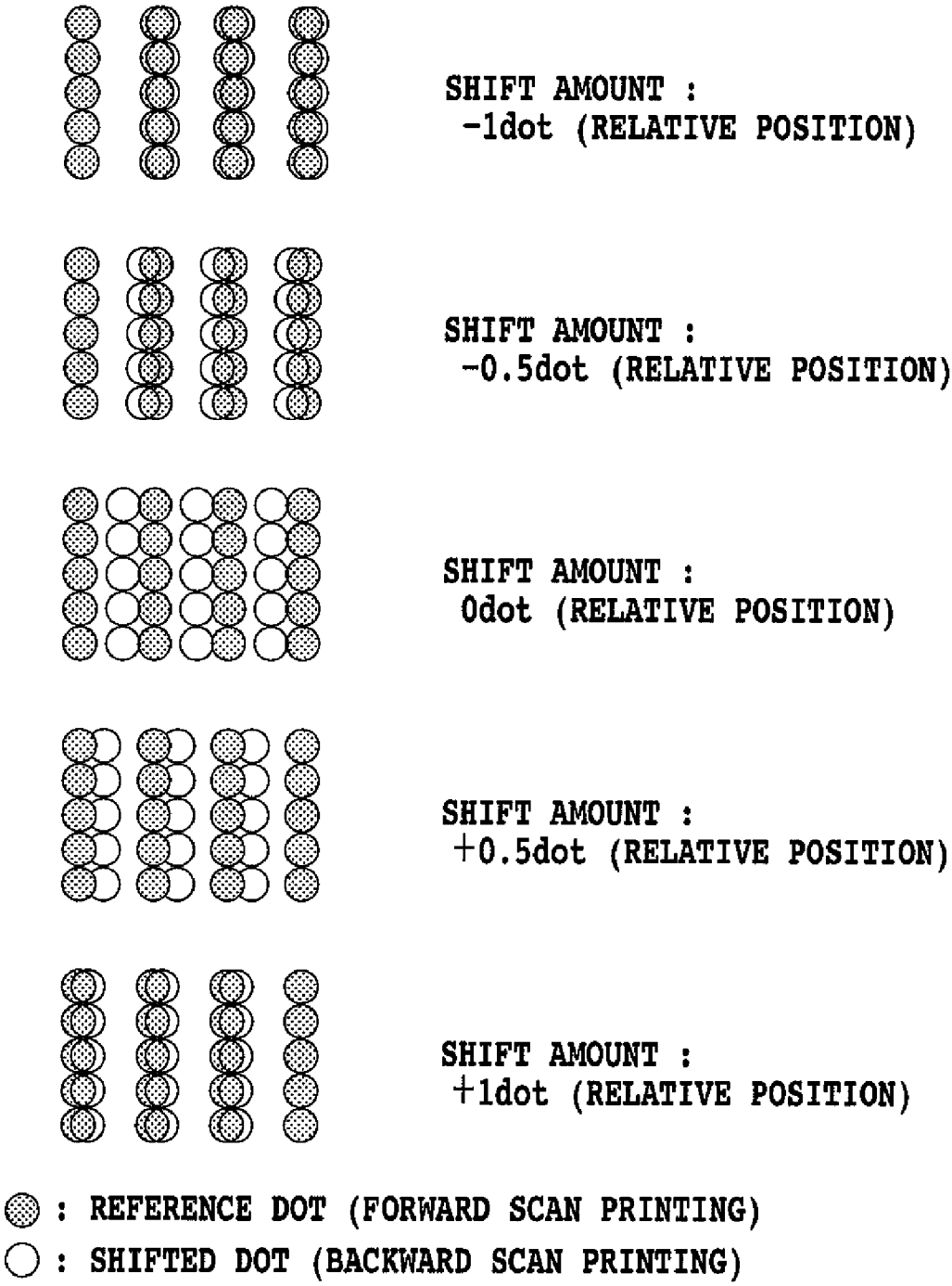
FIG. 10 is schematic illustrations of finely adjusted printing patterns in the above-mentioned automatic operation for the registration of the landing position.

Next, the fine adjustment of finer adjustment accuracy will be described below. In this embodiment, the fine adjustment of 0.5 dot intervals is adopted. FIG. 10 illustrates one example of the fine adjustment. In the same manner as in the rough adjustment, the reference dots are printed in the forward scanning and the shifted dots are printed in the backward scanning while changing the positioning conditions. The shift amount when the printing is carried out with no adjustment is 0 dot. Here, in the same manner as in the rough adjustment, the output characteristic of the photo sensor in relation to the shift amount is approximated by a polynomial expression, from which a point having the maximum reflection density is obtained as the adjustment value for displacement, that is, the registration adjustment value used in the bidirectional printing. The adjustment value may be smaller than an interval between the shifted dots; i.e., 0.5 dot. If the required adjustment accuracy is equal to the interval of the shifted dots, the shift amount wherein the reflection density has the maximum value may be adopted as the adjustment value for the bidirectional printing, without carrying out the approximation.

Finally, for confirming that the landing position alignment has been favorably controlled, the check pattern is printed. The check pattern is formed by the bidirectional printing while using a ruled line pattern easily discernible by the user based on the adjustment values obtained by the rough adjustment and the fine adjustment. Namely, two kinds of printing patterns are printed; the adjustment pattern for measuring the density for carrying out the adjustment and the check pattern for confirming the adjustment.

By having such a two-stage adjustment method for the rough adjustment and the fine adjustment, it is possible to adjust the maximum tolerance accuracy of the relative landing position of the printed dot to the high degree of accuracy in the bidirectional printing of the apparatus and the printing head through a series of automatic landing position adjustment processes. By preliminarily carrying out the rough adjustment, it is possible to minimize a range of the fine adjustment. This is effective for improving a total throughput of the sequence. Also, since there is no judgment of the user during the processes as in the case of user's adjustment, it is possible to restrict the generation of the adjustment mistake caused by the erroneous determination.

Acquisition of Registration Adjustment Value

The automatic landing position adjustment (the registration adjustment control) described above is carried out while changing the head-medium distance, to acquire the adjusted values for the respective head-medium distance.

Figure 11:
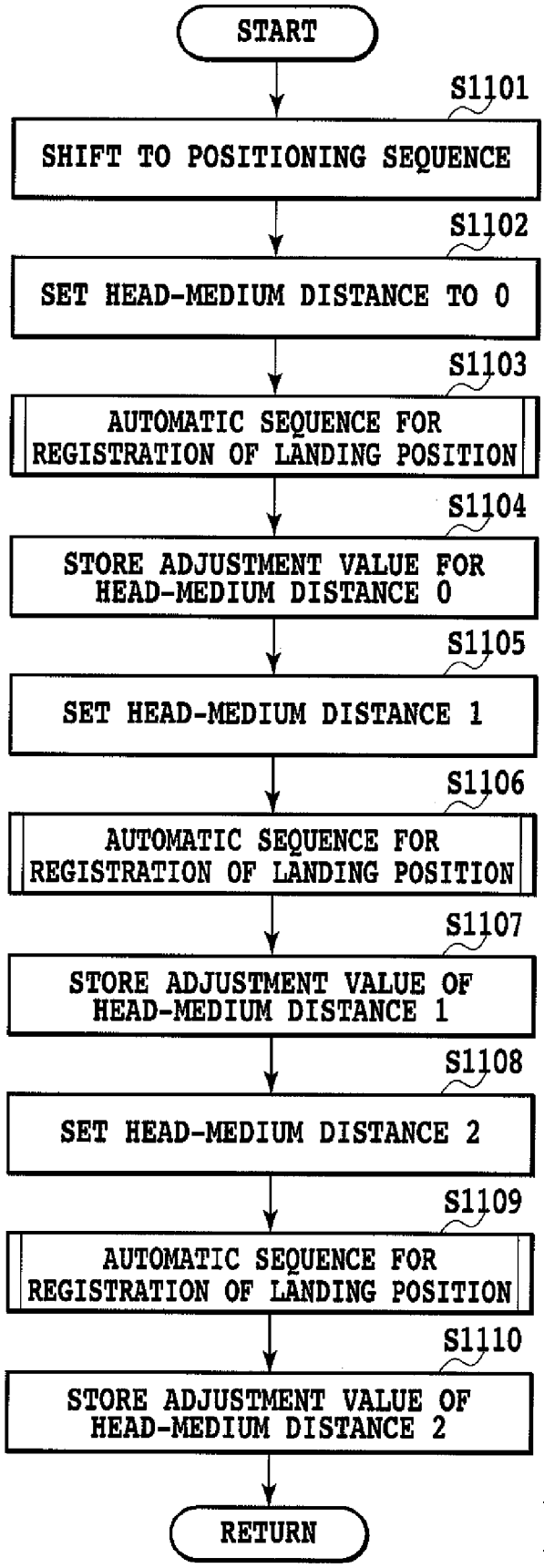
FIG. 11 is a flow chart illustrating the steps for obtaining adjusted registration values according to the operation for the registration of the landing position.

FIG. 11 is a flow chart showing processes for carrying out the automatic adjustment of the landing position for various head-medium distances. Initially, at step 1101, the routine shifts to a sequence of the automatic landing position adjustment of this embodiment. Here, the printing sheet for the positioning is set by the user, or the user is informed of the initiation of the position adjustment via UI of the driver or others. Then at step 1102, the head-medium distance of the apparatus is set at the head-medium distance 0. Here, the guide shaft lifting mechanism described before is used. Then, at step 1103, the automatic landing position adjustment sequence described in FIG. 7 is carried out. The adjustment value acquired at this step is stored in RAM or EEPROM as the adjustment value of the head-medium distance 0 at step 1104, and the operation for acquiring the adjustment value for the head-medium distance 0 has been completed.

Next, at step 1105, the head-medium distance of the printing apparatus is set at the head-medium distance 1 by the guide shaft lifting mechanism. At step 1106, the automatic landing position adjustment sequence is executed again. Here, the calibration of the LED in the photo sensor may be eliminated for the purpose of restricting the processing time. Then, at step 1107, the adjustment value thus acquired is stored as the adjustment value for the head-medium distance 1, and the operation for acquiring the adjustment value for the head-medium distance 1 has been completed.

Next at step 1108, the head-medium distance of the printing apparatus is set at the head-medium distance 2 by the guide shaft lifting mechanism. Then at step 1109, the automatic landing position adjustment sequence is executed in the same manner as described before. Further, at step 1110, the adjustment value thus acquired is stored as the adjustment value for the head-medium distance 2, and the operation for obtaining the adjustment value for the head-medium distance 2 has been completed, and this sequence has been finished.

One example of the adjustment values obtained by executing the processes shown in FIG. 11 is shown in FIG. 12 wherein actual head-medium distances (mm) and the adjustment values are shown in relation to the respective set values (0, 1, 2) of the head-medium distance. The head-medium distance 0 is set at the head-medium distance of 1.0 mm and the adjustment value of 8. Here, the control is carried out in a condition that a minimum unit is 2400 dpi. Accordingly, the adjustment value 8 means that the adjustment of approximately 85 μm is executed. Similarly, the head-medium distance 1 is set at the head-medium distance of 1.4 mm and the adjustment value of 12, whereby the adjustment of 127 μm is executed. Also, the head-medium distance 2 is set at the head-medium distance of 1.5 mm and the adjustment value of 14, whereby the adjustment of 148 μm is executed. In such a manner, since the respective head-medium distance independently has the adjustment value, if the printing operation is carried out as shown in FIG. 3, it is possible to restrict the displacement of the landing positions in the scanning direction.

In this embodiment, the landing position adjustment is carried out for the setting of three kinds of head-medium distance. However, when there is hardly the change in position of the printing sheet by the release of the pinch roller, depending on the structure of the printing apparatus, the operation for obtaining the adjustment value for the head-medium distance 2 is unnecessary and may be eliminated. On the contrary, if it is possible to set a more head-medium distance, the adjustment value may be corrected in correspondence thereto. As described above, according to the above-mentioned embodiment, it is possible to prevent the image-printing position from being displaced due to the behavior of the printing sheet at a position at which the rear end of the printing sheet exits from the nipped portion between the conveying roller and the pinch roller and carry out the proper image printing. Also, it is possible to carry out the proper image printing while preventing the displacement of the image-printing position caused by the lowering of the conveyance accuracy due to the separation between the conveying roller and the pinch roller.

In other words, the printing apparatus is provided, capable of executing the printing operation less in the influence of the lowering of the mechanical accuracy due to the exit of the printing sheet from the nip between the conveying roller and the pinch roller. Thereby, a high image quality printing less in defects of image such as unexpected streaks caused by the error of the landing position originated from the constitution of the mechanism is realized.

While this embodiment has been described solely on the rear section of the printing sheet, the present invention is, of course, effective for the deterioration of image due to the behavior of the printing sheet, not only in the rear end portions but also for the disturbance of the landing position when the printing sheet enters the delivery spur.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-341384, filed Dec. 19, 2006, which is hereby incorporated by reference herein in its entirety.

What is claimed is:

1. An ink jet printing apparatus that uses a printing head to eject ink onto a printing sheet to perform printing, the said apparatus comprising:

a pair of rollers for rotating which nip the printing sheet so as to convey the printing sheet to a position on which the printing is performed by the printing head;

a first printing control unit that causes a distance between the printing head and the printing sheet to be a first distance and executes printing by using the printing head;

a second printing control unit that causes the distance between the printing head and the printing sheet to be a second distance greater than the first distance and executes printing by using the printing head; and a changing unit that causes said first printing control unit to begin to execute printing, changes printing by said first printing control unit to printing by said second printing control unit before the printing sheet exits from a nip between said pair of rollers, in a printing operation for the printing sheet; and a releasing unit for separating said pair of rollers from each other before a rear end of the printing sheet exits from the nip between said pair of rollers, wherein said changing unit changes the printing before separating said pair of rollers from each other.

2. An ink jet printing apparatus as claimed in claim 1, further comprising:

a lifting control unit that moves the printing head in a direction perpendicular to a surface of the printing sheet; and wherein said changing unit causes said lifting control unit to move the printing head to increase the distance between the printing head and the printing sheet for changing the printing.

3. An ink jet printing apparatus as claimed in claim 2, wherein said changing unit causes said lifting control unit to move the printing head a plurality of times to increase the distance between the printing head and the printing sheet in a plurality of steps for changing the printing.

4. An ink jet printing apparatus as claimed in claim 1, further comprising:

a registration adjustment unit that performs an adjustment of printing positions in a scanning direction of the printing head, wherein said registration adjustment unit performs the adjustment of the printing positions correspondingly to the respective first and second distances.

5. An ink jet printing apparatus as claimed in claim 1, wherein said second printing control unit sets the second distance in accordance with a thickness of the printing sheet to be used for printing.

6. An ink jet printing method of using a printing head to eject ink onto a printing sheet, which is conveyed by rotation of a pair of rollers which nip the printing sheet to perform printing, the method comprising:

a step of causing a distance between the printing head and the printing sheet to be a first distance and initiating printing using the printing head; and a step of causing the distance between the printing head and the printing sheet to be a second distance greater than the first distance before the printing sheet exits from a nip between said pair of rollers, and executing printing using the printing head; and a step of separating the pair of rollers from each other before a rear end of the printing sheet exits from the nip between the pair of rollers, wherein the distance between the printing head and the printing sheet is changed from the first distance to the second distance before the pair of rollers are separated from each other.

* * * * *